United States Patent [19]

Sheldon

[11] 4,050,774

[45] Sept. 27, 1977

[54] CAP AND CONNECTOR FOR FIVE-WIRE APPLICATIONS

[75] Inventor: Luther M. Sheldon, Cranston, R.I.

[73] Assignee: General Electric Company, New York, N.Y.

[21] Appl. No.: 701,062

[22] Filed: June 30, 1976

[51] Int. Cl.[2] ..... H01R 7/12

[52] U.S. Cl. ..... 339/264 R; 339/272 A; 339/272 UC

[58] Field of Search ..... 339/264 R, 272 R, 272 A, 339/272 UC

[56] References Cited

U.S. PATENT DOCUMENTS

| | | | |
|---|---|---|---|
| 2,232,857 | 2/1941 | Jackson | 339/272 UC |
| 2,789,276 | 4/1957 | Hummel | 339/272 A |
| 3,392,362 | 7/1968 | Lipinski | 339/272 UC |

*Primary Examiner*—Roy Lake
*Assistant Examiner*—Mark S. Bicks
*Attorney, Agent, or Firm*—Paul E. Rochford; Walter C. Bernkopf

[57] ABSTRACT

An electric cap device and electric connector device are provided with means for connecting a plurality of wires in insulated relation to each other. Four independently insulated wire connectors are provided in the back of the device so that wire lying in an axial direction can be connected to the wire terminals and so that the wire terminals may be operated by an attachment means, such as a screw extending radially in the cap or connector housing. In addition a fifth central electrical contact is provided so that a fifth wire may be extended axially into the wire terminal and the wire terminal may be operated by a radially extended attachment means, such as a screw. The fifth wire terminal connecting to a fifth current carrying element of the cap or connector is independently insulated by an insulating wall extending up from and integrally with the insulating housing containing the contacts to which the five wires are attached.

1 Claim, 6 Drawing Figures

CAP AND CONNECTOR FOR FIVE-WIRE APPLICATIONS

RELATED APPLICATION

This application relates generally to the subject matter of the application Ser. No. 572,794 now U.S. Pat. No. 3,989,340 of Robert E. Maloof and Luther E. Sheldon filed Apr. 29, 1975; Ser. No. 572,793 of Fred Nelson filed Apr. 25, 1975; and Ser. No. 572,771 now U.S. Pat. No. 3,984,168 of Melvin Korman filed Apr. 29, 1975, all of which are by the same assignee as this application.

BACKGROUND

The present invention relates to a wiring device commonly known as a cap or a connector of the character described in the above applications. A distinction in the article of the present invention from that of those mentioned above is that the present invention relates to a structure having additional electrical capacity in the form of five wires for carrying electric current. The above described devices relate primalily to the structure of the insulating housing of the device rather than to its electrical utility of one sort or another. It is well known that electrical caps and connectors are the common designation of wiring devices which are employed to provide terminals to cables which carry power from power sources to apparatus in which the power may be utilized. The power source may be a wall receptacle and a cap is normally employed to connect into the wall receptacle to power the cable extending from the cap. The apparatus in which power may be utilized may be, for example, a machine and the machine may be permanently connected to the power cable by some internal mechanism. Alternatively, there may be a connector at the end of the cable and the connector will contain electrical contacts which are internally attached to the individual insulated wires of the cable terminating in the connector. A structure may be provided at the external surface of the machine which can mate with the connector so that the machine will derive power passing through the cable.

In ordinary household caps and connectors, there are normally only two wires and such wires are those which extend for example from a wall outlet to a lamp or to a fan or other household appliance. Numerous more complex household appliances, such as vacuum cleaners and the like, have three wires, two of which carry the power and a third of which is the grounding wire of the cable. In factories, mines, and other industrial sites, the cables may have three or four wires which carry power or which carry power and ground, and in some applications, five wires are needed.

Where the form of cap or connector which is employed is of the so-called locking variety, the device has locking blades and the use of such caps and connectors involves an insertion of the blades of the cap into matching blade ports of the connector and the turning of the cap relative to the connector in order to lock the locking blades in place in the connector. As a practical matter, the number of locking blades which can be employed around the face of a cap or connector is limited to four, simply because of the size of the individual locking blades and the need for the larger blade ports in the connector into which the blades are inserted and then partially rotated in accomplishing the locking action. Because of this limitation of space in the conventional cylinderical cap and matching cylinderical connector of the locking variety, the fifth electrical blade and contact has been a central axially located blade and contact. The center contacts can be of the pin and sleeve variety in-as-much as the locking action is accomplished by the four blades located in a circular pattern between the center pin and the outer perimiter of the cap. Similarly, the center contact of the connector which receives the center pin of the cap is of the non-locking variety in-as-much as the four contacts of the connector extend in an arc in a circular formation around the center contact between the center contact in the outer perimeter of the connector.

Most of the five-wire caps and connectors of the prior art have been characterized by a means at the rear of the center pin or center sleeve of the cap or connector, respectively, which has a somewhat awkward and cumbersome means for connecting the fifth and central wire of the five-wire cable to the respective pin or sleeve of the five-wire cap or connector.

Some specific structures which have been produced and which provide five-wire termination are a connector of Pass and Seymour and this structure has a center pin which has an axial thread at its internal end and has a shallow metal cup about the threaded internal end of the pin. Electrical eonnection to a cable wire is made by threading a screw into the axial threaded opening, wrapping the wire about the screw and tightening the screw to hold the wire in place in electrical contact with the internal end of the pin or sleeve. This is an awkward way of connecting a wire to the central pin or sleeve.

Another five-wire cap has a center pin and has a metal strip extending from the portion of the center pin where it enters the face of the cap. The metal strip provides a conducting path between the center pin and an assembly for assembling portions of the cap together. The assembly screw extends through the other end of the strip. There is, in this structure, no simple means for attachment of a fifth wire on the inside portion of the cap.

A structure of Bryant Co. has a center pin which extends through an insulating housing and which terminates in a cylinderical oversize pin terminal having a screw hole recessed into one side and having a wire entry port opening from its rear surface. The oversize pin is uninsulated.

Another five-wire plug of Pass and Seymour has a center pin which terminates in a centrally threaded plate at the internal end of the pin so that a screw can be threaded axially into the threaded opening in the rear plate and so that a wire can be wound about the screw to form a loop in a plan generally parallel both to the plane of the rear surface of the cap and also to the front surface of the cap, rather than extending axially into the screw terminal as is the case with the four screw terminals which are associated with the other four blades of the cap.

One characteristic which is common to all of these prior art devices is that there is no means by which the inner end of the pin or screw terminal associated with the inner end of the pin may be itself insulated. Accordingly, the entire surface of the inner end of the pin is at the potential of the pin itself and this may be ground potential or live potential depending on the manner in which the five-wire device is connected. Also, there is relatively inferior means for attaching a wire to the wire terminal at the inner end of the pin.

SUMMARY OF THE INVENTION

It is accordingly one object of the present invention to provide an improved cap and connector capable of connecting five wires of a five-wire cable.

Another object of the present invention is to provide an improved internal arrangement of elements for cap and connector devices having five terminal screws.

Another object is to provide an improved structure for a locking device type of cap and connector which has five blades for five blade receptacles.

Another object of the present invention is to provide a locking device having five blades including a center blade and having simple efficient effective means for connection to the center blade or contact.

Another object is to provide an internal structure for a locking cap or connector having five wire terminations where the fifth wire termination, although central to the structure, is insulatedly offset and displaced from this central location.

Still another object of the present invention is to provide a five-wire locking cap and connector and related devices in which the central fifth wire may be conveniently attached in insulated relation with the wire extending axially into a wire terminal electrically connected to the center pin of the fifth and central contact.

Other objects will be in part apparent and in part pointed out in the description which follows.

In one of its broader aspects, the object of the invention may be achieved by providing a unitized insulating housing having four wire ports on its internal surface for receiving four of the wires of a five-wire cable. Such ports may be arranged in a circular arrangement, with the circle lying between the center and the outer perimiter of the inner portion of the wire terminal housing. Further, there is formed integrally with the unitized housing a collar and compartment walls rising from the rear surface of the housing and extending toward the outer perimiter of the housing. Within this integral collar and compartment wall insulating structure is mounted a metal strip having a rivet opening at one end having a screw opening at the other end. The riveted end of the strap lays flat against the insulating housing and the remainder of the strip is bent into an inverted 'U' form so that the screw hole extends at right angles to the rivet hole. Intermediate between the rivet and the screw hole a wire entry port is formed in the strip in the upper surface of the inverted 'U'. Accordingly, as a wire end is inserted through the wire entry port, a screw extending through the screw hole will push the wire into electrical contact with the portion of the strip which forms a side of the 'U' and which is located between the rivet hole and the wire entry port. The end of an elongated pin or sleeve element extends through the rivet hole of the strip and joins the elongated element electrically to the strip.

BRIEF DESCRIPTION OF THE DRAWINGS

The invention disclosed and claimed herein will be more readily understood by reference to the accompanying drawings in which:

DESCRIPTION OF THE PREFERRED EMBODIMENT

Figure 6:
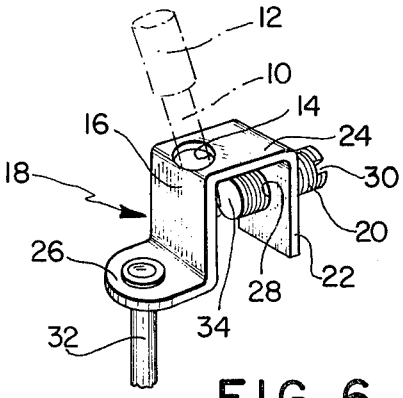
FIG. 6 is a detailed perspective view of the wire terminal portion of an electric contact of a cap and a connector as illustrated in FIG. 1.

Referring first to FIG. 6, a portion of an electric contact of a cap and connector and particularly a wire terminal portion is shown in perspective view. In this perspective view, the wire to be connected to the terminal is shown in phantom to have an exposed wire end 10 and an insulating jacket 12 extending back from the exposed end 10. The exposed end 10 is inserted into a wire entry port 14 in which it can make contact both with a vertical portion 16 of a strip 18 and with the inner end 34 of a screw member 20. The screw member is itself mounted in a second vertical portion 22 of the strip 18 and the two vertical portions 16 and 22 are joined by a horizontal portion 24 so that the overall contact has the form of an inverted 'U' with a laterally extending tab or side arm 26 extending from the free end of the upright 16 of the inverted 'U'. The screw member 20 extends through the portion 22 of strip 18 through a threaded hole 28. The screw is moved in or out in its threaded relation with strip 18 by the use of a tool in slot 30 of screw 20.

The side arm 26 has a hole through which extends an upper end of an elongated element 32.

Figure 5:
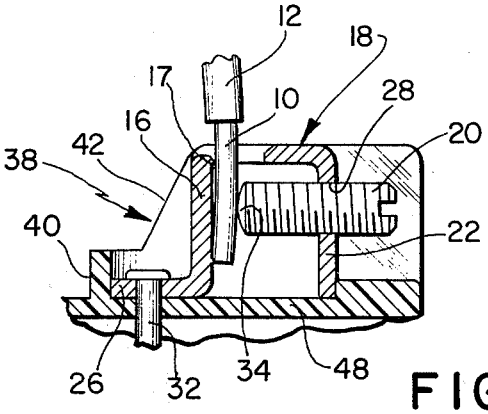
FIG. 5 is a partial sectional view of a portion of the connector of FIG. 1 taken along the axis of the generally cylindrical connector article and illustrating the relationship of a wire terminal to a wire extending into the wire terminal.

The relations of the various parts may be seen also in the FIG. 5 in which some parts are shown in section, including portions of the insulating housing associated with the strip portion 18 of the contact. In FIG. 5 it is evident that an exposed end 10 of a wire of a cable extends from an insulated sheathing 12. The exposed end 10 is illustrated in position to be pressed against the inner surface 17 of upright 16 of the strip 18. This pressing is accomplished by turning the screw 22 in threaded hole 28 to bring the end 34 of the screw member 22 against wire 10 and to press the wire 10 against the surface 17 to establish good electrical contact therebetween.

Figure 1:
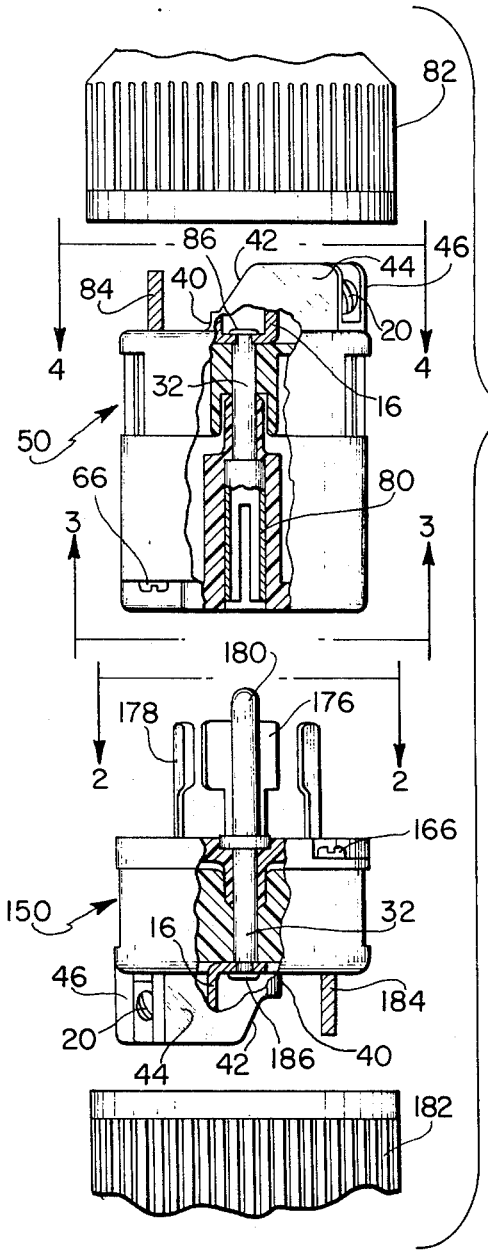
FIG. 1 is an exploded view of a cap and of a connector as provided pursuant to this invention showing components thereof in part in section and in part cut away to emphasize the relationships of the various components and parts.

The strip 18 itself is nested within a conforming upper extension 38 of the housing provided in both the cap and the connector. The extension insulatedly houses the remaining terminals of the cap and connector as illustrated in FIG. 1. The upper portion or extension 38 of insulating housing includes a collar 40 extending around the side arm 26 of strip 18. It also includes a pair of ramps 42 extending up from collar 40 to insulating walls 44 which walls extend the length of the 'U' shaped portion of strip 18. The walls also extend beyond the 'U' shaped portion to provide insulating side walls 46 about the outer end of screw member 22.

The collar and ramp and wall portions of the upward extension 38 of the insulating housing is formed integrally with the housing and on the upper surface or platform portion 48 of the housing.

Figure 3:
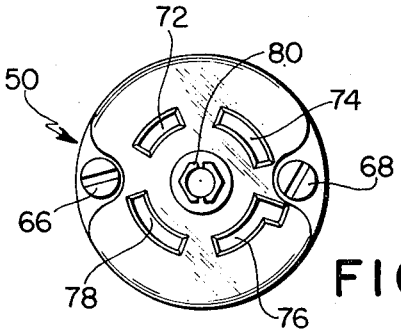
FIG. 3 is a bottom plan view taken along the line 3—3 of FIG. 1 and showing the face of the connector illustrated in the upper part of FIG. 1.
Figure 4:
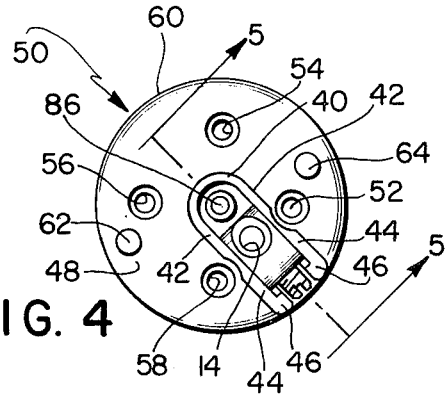
FIG. 4 is a rear plan view of the connector of FIG. 1 taken along the line 4—4 of FIG. 1 and illustrating the rear surface of the connector as shown in the upper part of FIG. 1.

The relationship of the wire entry port 14 of strip 18 to the wire entry ports in platform 48 of the housing 50 is evident in FIG. 4 where the four wire entry ports 52, 54, 56, and 58 are shown at points around a generally circular path lying between the center axis of the generally cylindrical housing 50 and the outer perimeter 60 of the housing. The ports 62 and 64 are assembly screw ports for the assembly screws shown better as screws 66 and 68 of FIG. 3 and 166 and 168 of FIG. 2.

The wire entry ports 52, 54, 56, and 58 are positioned directly above the wire terminal portions of contacts enclosed within the insulating housing of the connector illustrated in the upper portion of FIG. 1. In FIG. 1, one such port is located directly in line with the broken away portion of the housing of connector 50 so that no parts of the port 58 or of the contact internally of the connector 50 are seen. The cut away and broken away portion of connector 50 extends entirely through this outer part of the connector structure and illustrates the center contact structure described above with reference to FIGS. 5 and 6.

In FIG. 3 the face of the connector housing 50 is illustrated but the housing is rotated slightly from the position shown in FIG. 1. Thus the screw 66 is illustrated in a slightly foreward position in FIG. 1. In FIG. 3 the face of the connector is rotated slightly so that both screws 66 and 68 appear on the same horizontal line of the figure.

Figure 2:
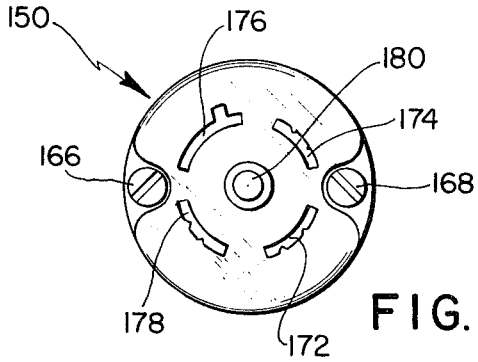
FIG. 2 is a top plan view taken along the line 2—2 of FIG. 1 and illustrating the face of a cap and electric contacts extending therefrom.

The individual ports 72, 74, 76, and 78 are provided in the face of housing 50 to admit conforming blades illustrated in FIGS. 1 and 2. The blades within the insulating housing 150 of FIG. 2 include the blades 176 which conforms to blade opening 76; blade 174 which conforms to blade opening 74; blade 172 which conforms to blade opening 72; and blade 178 which conforms to blade opening 78. A central blade 180 is in the form of an elongated element such as a pin or a rod. It is adapted to mate with an elongated element in the form of a hollow rod or sleeve 80 of connector 50. The blades and housing are illustrated in top plan view in FIG. 2 and in side elevation in part cut away in the lower portion of FIG. 1. The connector is illustrated in bottom plan view in FIG. 3 and in side plan view in part cut away in the top portion of FIG. 1.

Above the connector of FIG. 1 an outer housing 82 is illustrated poised in a position to be lowered into an assembled arrangement around the insulating housing 50. The threaded end 84 of assembly screws 66 is adapted to engage matching internal opening within the outer housing 82 to secure the outer housing in insulated relationship around a main portion of the insulated housing 50.

Similarly, the threaded portion 184 of assembly screw 166 is illustrated in position to enter a conforming opening within the outer housing element 182 evident below the cap at the lower portion of FIG. 1 and poised in a position to be assembled about the inner insulating housing 150 of the cap.

The advantages made possible by the structure of the present invention may be seen and will be evident by reference to FIG. 1 taken in combination with the other figures. In FIG. 1 it is evident that the fifth or central pin contact 180 of the cap and sleeve contact 80 of the connector, both of which are referred to herein and in the claims which follow as an elongated element, are provided with a unique strip of metal at their outer end. This strip is attached to the elongated element by a deforming of the outer end of the elongated elements into rivet-like attachments 86 and 186 so that secure electrical connection is established and maintained between the elongated element of the cap and the connector and its respective strip forming the wire terminal of the central contact of the cap and connector.

In fact, the pin contact 180 of the cap and the sleeve contact 80 of the connector are not themselves unique. Elongated conductive elements, such as pins and other elongated elements such as sleeves have been employed in an axial location in caps and connectors adapted for use with five wires. The center element of devices described above as prior art devices have the general character of pin and sleeve elements. But none of these elements have been employed in the manner taught herein, that is, in a manner including a unique wire terminal for the elongated conductive element of the contact. This unique wire terminal is made up simply from a conductive metal strip which is readily attached to and extends generally at right angles from the end of elongated element 80 or 180. In fact, the strip such as 18 of FIG. 5 is the same whether it is employed with the cap or with the connector. Further, the insulating housing 38 partially enclosing and protecting the strip 18 is the same for either the cap or the connector.

What is distinctively advantageous about the structure of the present invention is that the structure permits a very ready and reliable connection of five-wire cable to a cap and to a connector having the structure shown and claimed in this application. Thus it is evident that the means for connecting to the elongated element 80 or 180 of the respective devices is by a strip of metal attached at one end to the elongated element and providing a readily accessible and yet insulated wire connection terminal. The strip itself, in combination with the elongated element, constitutes the fifth electrical contact of the cap or of the connector and the strip itself is specially adapted to receive a fifth wire of a cable in a very simple and reliable fashion, particularly in-as-much as the fifth wire itself enters the formed strip axially as do the other four wires of the connector and also in-as-much as the securing of the wire in place in the wire terminal is accomplished by manipulating a screw of the terminal in an axial direction just as the screws of the other terminals of the cap and connector are manipulated in securing the respective wires thereto. Accordingly, the structure of the present invention provides for the first time a simple, convenient, insulated, terminal structure for a fifth wire of a five-wire cable, and provides the termination with great economy are reliability.

In the actual use which has been made of this device, the time for accomplishing the attachment of the wires of a five-wire cable to the respective wire terminals of the device is found to be desirably low and the reliability of connection is found to be desirably high.

I claim:

1. A wiring device for connection to a plurality of wires of an electric cable comprising an insulating housing of generally cylindrical form, electrical contacts at least partially within said housing, said contacts being adapted to receive at an inner end portion thereof electrical conductors of a multiconductor cable, said contacts being adapted to mate at the other end portion thereof with complimentary contacts of another wiring device, one of said contacts being made up at its inner end of a strip portion and at its outer end of an elongated element of generally rod like configuration, the elongated element extending along the axis of the cylindrical housing, the strip portion of said contact being attached at the inner end of said elongated element and extending in a generally radial direction from said element, the strip portion of said contact being in the form of an inverted "U" having a first and a second upright and a cross element and having a side arm extending from the end of the first upright of the "U", the strip portion being attached at its side arm to the inner end of the elongated element, the strip having a wire entry port located in the cross element of the U, the strip having a threaded opening in the second upright of the U, a screw element in the threaded opening adapted to urge a wire extending through said wire entry port against the inner surface of the first upright of the U, and insulating walls extending up from and integral with the insulating housing and partically enclosing said strip at its sides and side arm and contacting the free ends of the strip to prevent separation of said first and second uprights.

* * * * *